United States Patent [19]

Wrigglesworth

[11] 4,157,636

[45] Jun. 12, 1979

[54] CONTROL MEANS FOR A LENS-EDGE GRINDING MACHINE

[75] Inventor: Stanley Wrigglesworth, Driffield, England

[73] Assignee: Rodway Optical Industries Limited, Yorkshire, England

[21] Appl. No.: 642,528

[22] Filed: Dec. 19, 1975

Related U.S. Application Data

[63] Continuation of Ser. No. 513,894, Oct. 10, 1974, abandoned, which is a continuation-in-part of Ser. No. 324,821, Jan. 18, 1973, abandoned.

[30] Foreign Application Priority Data

Jan. 22, 1972 [GB] United Kingdom ..... 3141/72

[51] Int. Cl.[2] ..... B24B 9/14

[52] U.S. Cl. ..... 51/101 LG

[58] Field of Search ..... 51/2 J, 100 R, 101 R, 51/101 LG, 94 R, 284

[56] References Cited

U.S. PATENT DOCUMENTS

| | | | |
|---|---|---|---|
| 1,619,358 | 3/1927 | Maynard | 51/101 LG |
| 1,651,532 | 12/1927 | Maynard | 51/101 LE |
| 2,584,483 | 2/1952 | McDonald | 51/94 C |
| 2,617,236 | 11/1952 | Allen | 51/101 LG |
| 3,332,172 | 7/1967 | Stern | 51/101 LG |
| 3,513,598 | 5/1970 | Asselin | 51/101 LG |

FOREIGN PATENT DOCUMENTS

| | | | |
|---|---|---|---|
| 1369912 | 10/1974 | United Kingdom | 51/101 LG |

*Primary Examiner*—Nicholas P. Godici

*Attorney, Agent, or Firm*—William Anthony Drucker

[57] ABSTRACT

Control means for a lens edge grinding machine having its rotatable lens carrier in an assembly rockable about an axis to impart contour to a lens and axially movable along such axis to cater for curvature of the lens being ground, which control means comprises a surface angularly adjustable between a minimum for a flat front faced lens to a maximum for a curved front lens of the power of some eight to ten diopters and linearly adjustable for size and/or thickness of the lens such that an element, movable with the rockable lens carrier assembly biased by a force tending to axially displace the same, bears on such surface to control axial displacement during grinding a lens rotated in the grinding machine as a function of the rocking of said assembly.

2 Claims, 5 Drawing Figures

CONTROL MEANS FOR A LENS-EDGE GRINDING MACHINE

This is a continuation of application Ser. No. 513,894, filed Oct. 10, 1974, now abandoned which was a continuation-in-part of Ser. No. 324,821, filed Jan. 18, 1973 now abandoned.

BACKGROUND TO THE INVENTION

In lens edge grinding machines at present available to the lens grinding industry it is well known to carry a lens, to be ground by rotation thereof relative to the periphery of a rotary grinding wheel, in an assembly which is rockable about an axis under control of a cam which determines the contour shape of the lens and which is axially displaceable along such axis to cater for the curvature of the lens. In such machines it is known to provide another cam for controlling the linear displacement of the assembly and as such further cam is related to the contour cam it is necessary to set up the machine for grinding each particular shape and curvature of lens, and must thereafter be reset even though a similar shape lens is next to be ground when its curvature is different. Furthermore it is known to cause the assembly to move axially to follow the curvature of the lens by means of a part bearing on the face of the lens but this may cause slight scratching or damage to the lens.

This invention relates to control means for machines for grinding the edges of spectable and like lens, in particular for providing a V-rib therearound for the fixing of the lens in its frame or carrier.

The object of the invention is to provide control means for lens edge grinding machines, which may be set up to grind a lens according to size and thickness and required contour shape, and with the control means set for a particular curvature of lens may then be used for grinding further lenses of the same curvature without further adjustment; the control means being utilisable either alone or in conjunction with a lens deflecting element claimed in U.S. Pat. No. 3,562,963 which is for use in the same kind of lens edge grinding machines.

The object of the invention is furthermore to provide such control means comprising a control surface angularly adjustable between a minimum for plane lens to a maximum for lens of some eight to ten diopters and linearly adjustable for size and/or thickness of the lens such that an element, movable with the lens carrying assembly urged to bear on such surface by the bias on such assembly, causes said assembly to follow a presettable curvature pattern during the grinding of the edge of a lens. Thus as said element moves to and fro along said control surface, due to the rocking of said lens carrying assembly determined by the required contour shape of the lens being ground, it axially displaces said assembly to cater for pre-set curvature of the lens related to the contour shape of the lens.

The control surface may be straight or curved and may comprise the edge of a metallic plate rockably mounted in a linearly movable mount. Such plate may be infinitely angularly variable between vertical and some 15° to the vertical or may be so angularly adjustable through a plurality of steps, corresponding to for example lens curvature from 0 to 8 diopters, and be lockable in adjusted angular position. When infinitely variable the locking means may comprise a clamp and when by steps may comprise a, preferably spring-loaded, member engageable in one of a plurality of recesses or apertures.

The control surface plate mount may be linearly movable by a feed screw and is also preferably provided with looking means. It may be provided with a datum mark or indicator movable relative to marks or a scale provided on a non-movable part by reference to which such mount may be set appropriately to particular thickness and/or size of lens.

To ensure such contact of the element with the control surface plate, the lens carrying assembly is biased for movement in appropriate direction by known means such as by spring pressure or the pull of weights, but preferably is effected by magnetic or electro-motive force.

In a known lens edge grinding machine, in which the lens carrying assembly is axially movable along and rockable about a horizontal shaft, there is provided, on such assembly or on a casing enclosing and movable therewith, an armature through which the horizontal shaft extends, and a permanent or electro-magnet is affixed to the end of such shaft, for example on the end bearing thereof, such that the force of such magnet acting on the armature tends to pull the lens carrying assembly axially of the shaft without affecting the rocking movement thereof. In this way the assembly is urged in the direction for the element, conveniently in the form of a projecting stud, to contact with the effective surface of the control surface plate along which it moves due to rocking movement of the lens carrying assembly.

BRIEF DESCRIPTION OF KNOWN LENS EDGE GRINDING MACHINE

Figure 4:
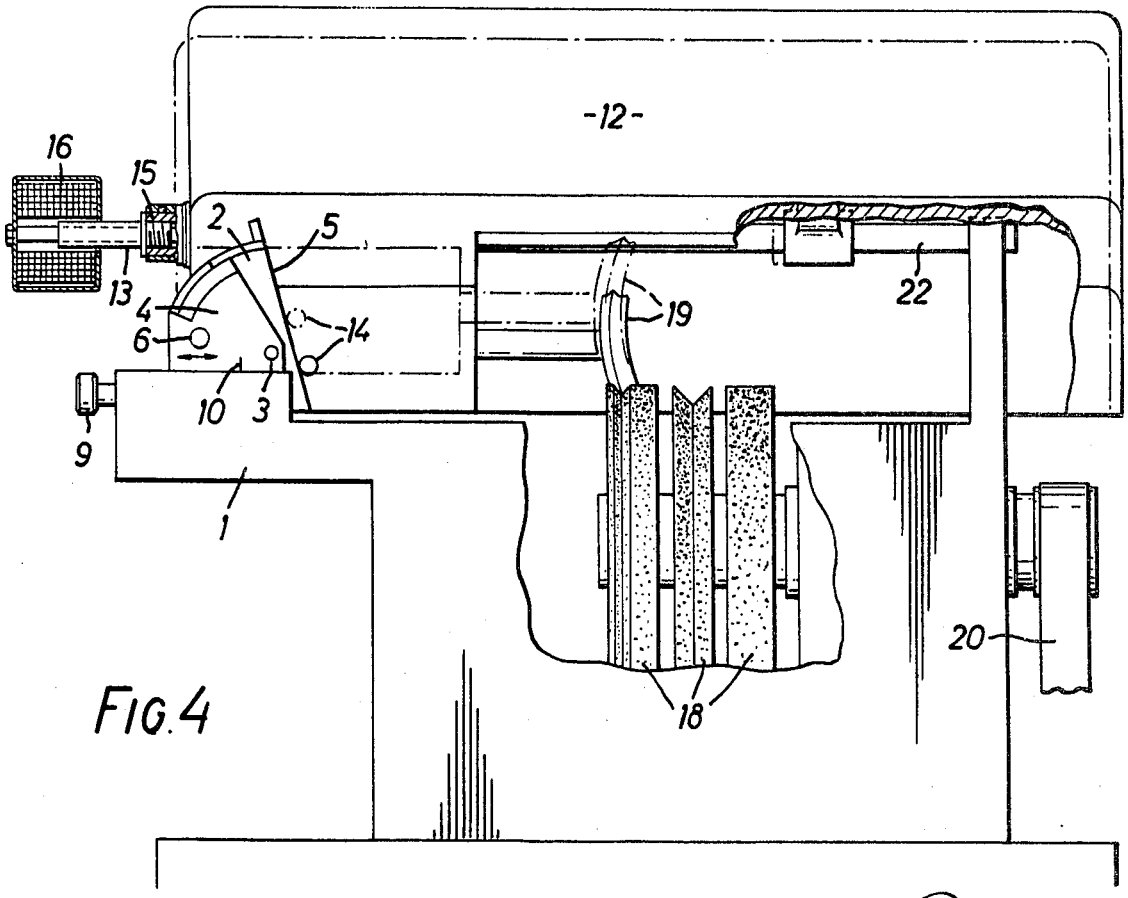
Figure 5:
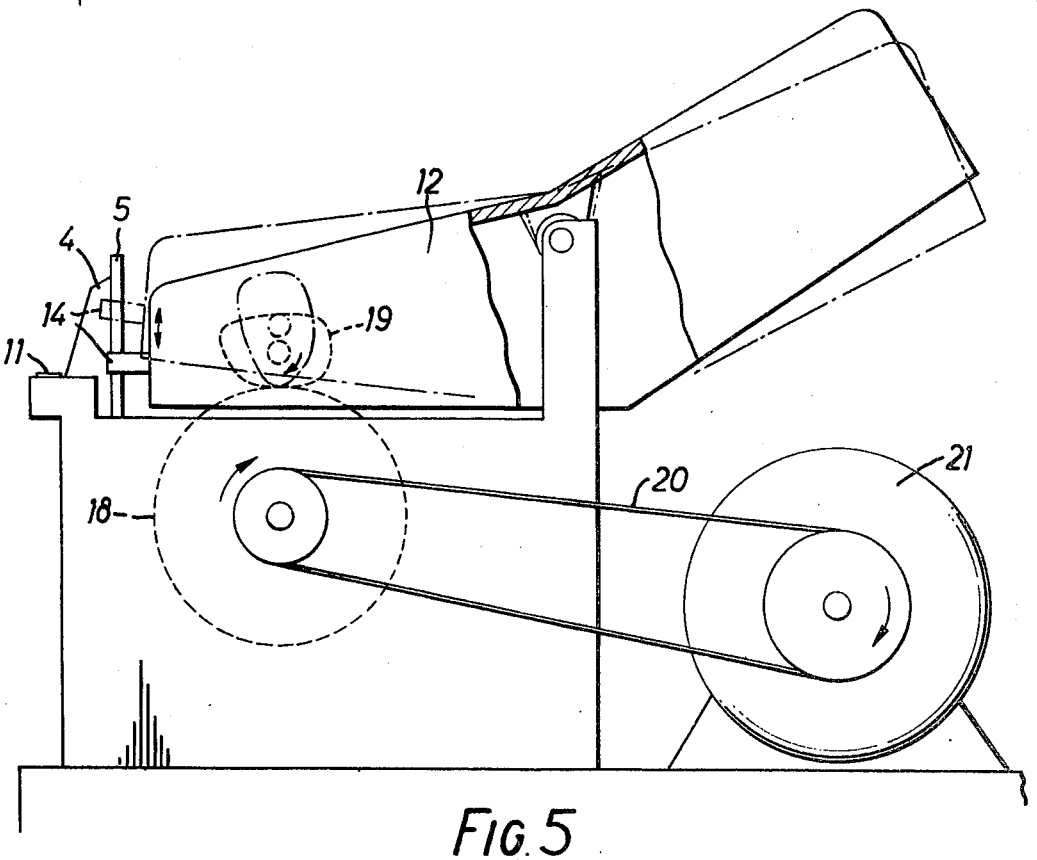

The lens edge grinding machine illustrated in FIGS. 4 and 5 comprises a stationary base structure provided with grinding wheels 18 on a common shaft driven by an endless belt 20 by a motor 21. The structure 1 supports a shaft 22 on which the rockable and axially displaceable part of the machine is mounted. Such displaceable part of the machine includes within a casing 12, a holder for a lens 19 on a shaft with a motor for rotating the same and the customary cam means for controlling rocking movement to move the rotation axis of the lens holder towards and away from the rotation axis of the grinding wheels 18 to cater for the contour shape of the lens being ground. Such displaceable part is also provided with means for biassing the casing and internal assembly for movement (towards the left as seen in FIG. 4) along the shaft 22 to cater, as is known, for the curvature of the lens being ground.

DESCRIPTION OF PREFERRED EMBODIMENT OF THE INVENTION

A structure 1, adapted to be secured to the top front portion of the base structure of the lens edge grinding machine, carries the pre-settable axial displacement control which which comprises a plate 2 rockable about a pivot 3 of a mount part 4 and having a control surface or edge 5 which may be straight (as shown) or curved. The plate 2 may be infinitely angularly variable to position the edge 5 between vertical and some 15° to the vertical and be capable of being clamped in adjusted position but, preferably and as shown, is angularly adjustable by steps and a spring loaded axially movable locking element 6 is engageable with recesses or apertures corresponding in number to such steps, which correspond to lens curvatures of 0 to 8 diopters, indicated by FIGS. 7 on the face of the plate 2 movable relative to a mark or datum line 8 on the mount 4. The carrier 4 is linearly displaceable by being engaged with a feed screw rotatable by an end head 9 and such mount is preferably provided with a pointer or datum line 10 movable relative to marks or a scale 11 provided on the structure 1.

Figure 1:
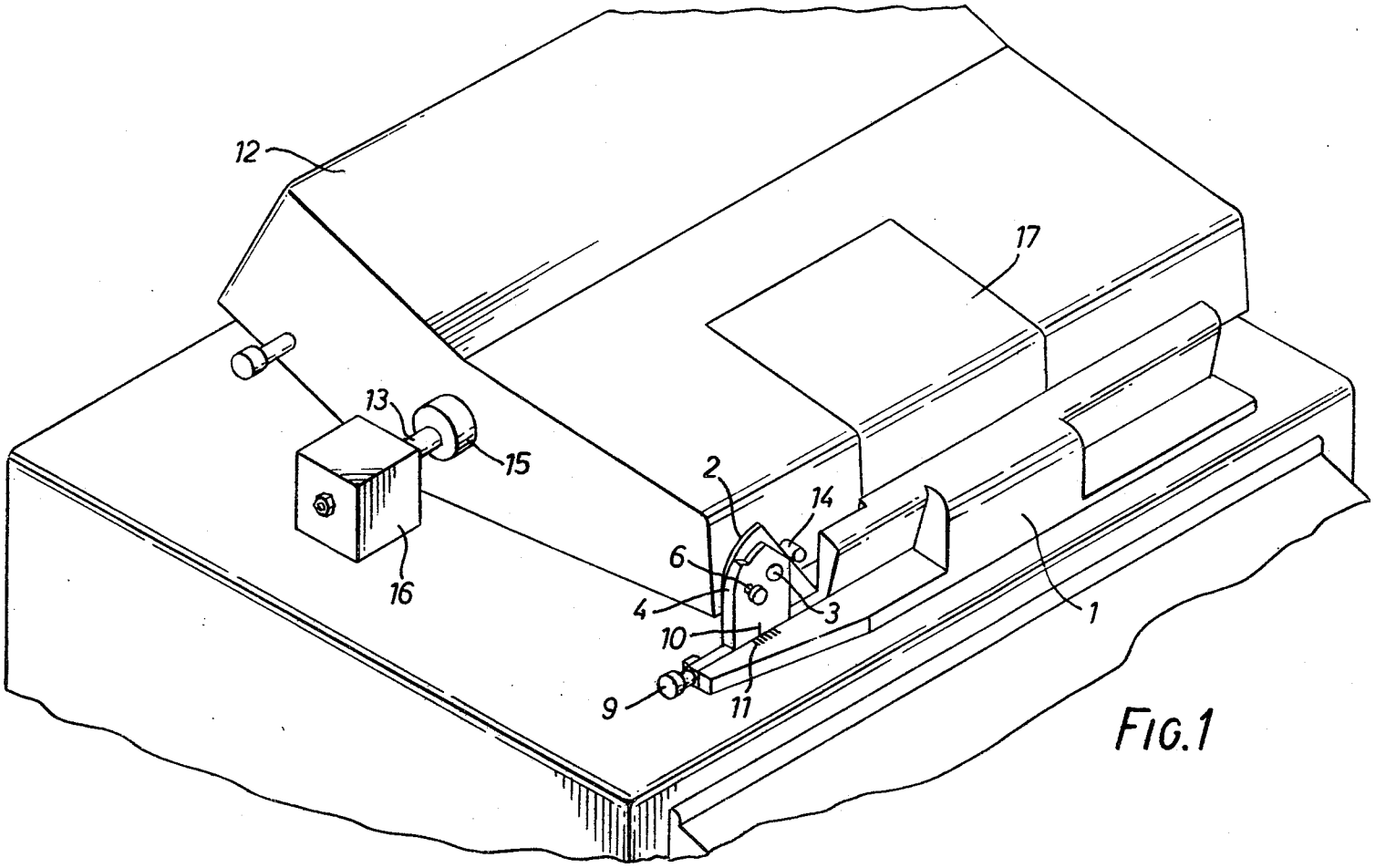
FIG. 1 is a perspective of the top of a known lens edge grinding machine having its lens holder and means for rotating the same in an assembly in a casing rockable about shaft under cam control to move the axis of the lens towards and away from the axis of a rotary grinding wheel, which with its driving motor is mounted in a stationary part of the machine, to cater for the contour shape of the lens, and which assembly and casing is also axially displaceable along said shaft to cater for the curvature of the lens; the drawing showing axial displacement means engaged by a stud projecting from such casing on which is an annular armature through which such shaft extends and on which is a magnet effective on said armature to bias the casing with its internal lens carrying assembly in the direction axially of said shaft to cause said stud to bear on said control means.
Figure 2:
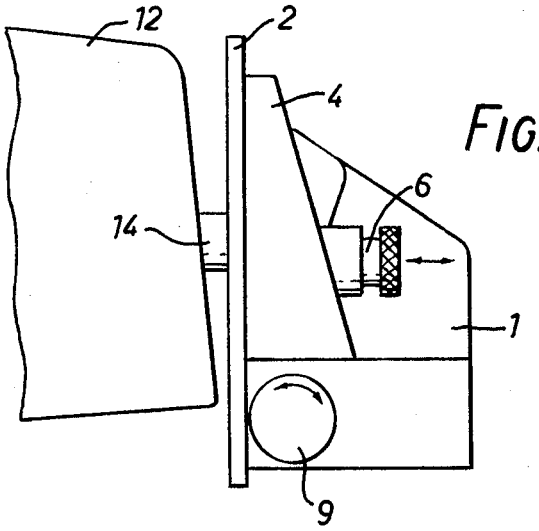
FIG. 2 is an end elevation of the lateral displacement control means being a view on the left hand end of FIG. 1 on an enlarged scale.
Figure 3:
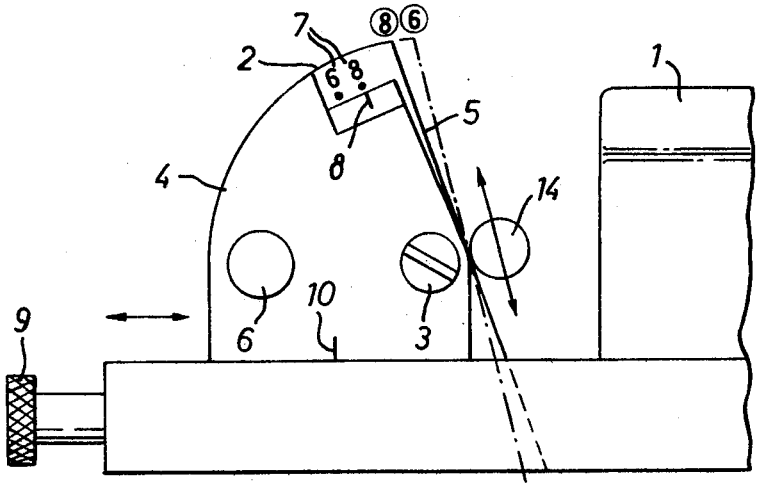
FIG. 3 is a front elevation of the control means on the scale of FIG. 2, and FIGS. 4 and 5 are front and end elevations respectively of the known kind of lens edge grinding machine, with parts of such drawings cut away to show internal parts within the rockable and axially movable casing and of the stationary base portion of the machine in which the grinding wheels and drive are provided, to illustrate more clearly the application of the new control means illustrated in FIGS. 2 and 3 to such lens edge grinding machine.

The lens holder assembly within a casing 12, forming the displaceable portion of the machine axially movable on and rockable about the shaft 22, has on the front of such casing 12 a projecting stud 14. With the casing 12 biased, to the left as seen in FIGS. 1 and 3, the stud 14 contacts the control edge 5. Thus the casing 12 and hence the lens carrier may move axially along the shaft 22 to an extent determined by the angularity of the edge 5; the point of contact with such edge being determined by the linear adjustment of its carrier by means of the head 9 to cater for lens thickness and/or size.

The rocking movement of the casing 12 during the grinding of a lens edge causes the stud 14 to move to and fro along the surface 5 and, determined by the angularity thereof, a lateral displacement of the casing 12 against the bias thereon to cater for the curvature of the lens, so that a V-rib formed on the edge of the lens is accurately positioned to a pre-set curve related to the contour shape of the lens.

Various and known means may be provided for biassing the casing 12 axially along its shaft 22, but it is preferred to provide such casing with an annular armature 15 with a sleeve portion 13 passed through by a brass extension of the shaft 22 and to provide a permanent or electro-magnet (not shown) disposed about such sleeve portion 13 and the shaft extension and conveniently in the casing 16 secured to the end of the shaft extension. In this way there is provided the required axial pull on the casing 12 without affecting the rocking movement thereof. An electro-magnet is preferred as it may be switched off when not required and the arrangement may be such that such electro-magnet is automatically switched off when the casing 12 is moved sufficiently for a second of the grinding wheels 18 to be positioned to grind a flat edge on a lens.

The casing 12 is provided with a displaceable flap 17 providing access to the grinding wheel(s) 18 and to enable a lens to be edge ground to be engaged by the lens holder.

The control mechanism may be applied to existing lens edge grinding machines of the kind referred to above as well as to newly constructed machines of such kind.

I claim:

1. Control means, for a lens-edge grinding machine of the kind including a frame structure, pivot means on said frame structure, a lens carrier assembly mounted by said pivot means on said frame structure and rockable about on and translatable linearly along the axis of said pivot means, and means biasing said lens carrier assembly in one axial direction along said pivot means, said control means comprising:

(i) a mount linearly slidable on said frame structure parallel to the axis of the pivot means, (ii) means acting between said mount and said frame structure for adjusting said mount linearly thereon and for retaining said mount in a selected position of linear adjustment (iii) a pivot on said mount having its axis normal to the plane of linear adjustment of said mount, (iv) a linear edge cam supported rotatably on said mount by said pivot, (v) means acting between said linear edge cam and said mount for retaining said linear edge cam in a selected position of rotation about said pivot, and (vi) a follower on said lens carrier assembly position by said bias to coact with said linear edge cam for effecting linear movement of the carrier assembly as a function of rocking movement thereof, said linear edge cam retaining means comprising a locking element movably positioned in said mount for engagement in any selected one of a plurality of recesses in said edge cam, and means resiliently urging said locking element into engaged position.

2. Control means, as claimed in claim 1, wherein said mount adjusting means comprise a feed screw journalled rotatably in said frame structure and secured against axial movement therein, and means on said mount engaging with the threading of said feed screw.

* * * * *